US008376212B2

(12) United States Patent
Ashe et al.

(10) Patent No.: US 8,376,212 B2
(45) Date of Patent: Feb. 19, 2013

(54) AUTOMATED FLAT MAIL PIECE

(75) Inventors: Peter G. Ashe, Webster, NY (US); Glenn J. Marino, Victor, NY (US); Craig A. Reynolds, Henrietta, NY (US)

(73) Assignee: Consolidated Graphics, Inc., Houston, TX (US)

( * ) Notice: Subject to any disclaimer, the term of this patent is extended or adjusted under 35 U.S.C. 154(b) by 408 days.

(21) Appl. No.: 12/792,473

(22) Filed: Jun. 2, 2010

(65) Prior Publication Data

US 2011/0049224 A1 Mar. 3, 2011

Related U.S. Application Data

(60) Provisional application No. 61/239,498, filed on Sep. 3, 2009.

(51) Int. Cl.
*B65D 27/02* (2006.01)

(52) U.S. Cl. ..... 229/68.1; 229/72

(58) Field of Classification Search ..... 229/68.1, 229/117.01, 67.3, 928
See application file for complete search history.

(56) References Cited

U.S. PATENT DOCUMENTS 4,093,117 A * 6/1978 Morse ..... 229/70
2008/0290145 A1* 11/2008 Makofsky et al. ..... 229/68.1

FOREIGN PATENT DOCUMENTS

FR 2683795 A1 * 5/1993

* cited by examiner

*Primary Examiner* — Gary Elkins
*Assistant Examiner* — Christopher Demeree
(74) *Attorney, Agent, or Firm* — Tracy Jong Law Firm; Tracy P. Jong; Cheng Ning Jong

(57) ABSTRACT

An automated flat mail piece comprising a bendable envelope and a bendable insert tray disposed inside the cavity of the bendable envelope that satisfies USPS requirements for automated flats. The insert tray has a rectangular base with a perforated line disposed centrally from each edge to its respective opposing edge, dividing the base into four segments. A flap is integrally connected to the base by two walls extending at substantially right angle from the base. A set of three bend-enabling score lines disposed co-linear with the longitudinal and transverse bend axes of the envelope enable lengthwise and widthwise bending of the envelope. Diagonal stress relief score lines cooperate with bend enabling score lines to lessen the effects of a crease. A stress relief score line is disposed diagonally extending from an outer bend-enabling score line at the envelope edge to a center bend-enabling score line.

23 Claims, 10 Drawing Sheets

AUTOMATED FLAT MAIL PIECE

PRIORITY CLAIM AND RELATED APPLICATIONS

This application claims the benefit of priority from provisional application U.S. Ser. No. 61/239,498 filed Sep. 3, 2009 entitled "Automated Flat Mail Piece." This application is incorporated by reference in its entirety.

BACKGROUND OF THE INVENTION

1. The Field of the Invention

The present invention is directed generally to packages, and in particular, a package that converts a parcel or a not automated flat mail piece to an automated flat mail piece.

2. Background Art

Envelopes have long been known in the art as a quick and efficient way of containing small articles for mail delivery. It has become increasingly important to move away from mailing articles that require manual sorting to mailing articles that are machine sortable. An automated flat mail piece requires little to no human intervention during processing and sorting, resulting in lower mailing costs than manually handled mail pieces.

The United States Postal Service (USPS) requires that an automated flat mail piece conform to certain mail regulations. One of the requirements to enable automated flat mail processing is that a mail piece must bend easily when subjected to a transport belt tension of 40 pounds around an 11-inch diameter turn. In order to qualify as an "automated flat," the USPS also requires that the mail piece thickness to be no less than 0.25 inch and to not exceed 0.75 inch. If the shipper fails to meet the strict USPS requirements, it may be responsible for surcharges for mail pieces destined for automated mailing equipment that fail to meet USPS's automated flat mail requirements, and/or cause the machines to experience stoppages due to the nonconforming mail pieces. For a non-flat three dimension article, this requirement poses a challenge: to provide an envelope system that is both bendable and can hold articles securely without damage to the article. None is presently known in the art.

Thus, there is a need for a device which overcomes the limitations and drawbacks of the prior art by meeting the USPS requirements for a system that converts a parcel or not automated flat mail piece to an automated flat mail piece.

SUMMARY OF THE INVENTION

Many articles are traditionally mailed in envelopes or boxes requiring manual sorting and handling. As with most chores involving labor, higher costs are associated with the manual processing of mail. Increased costs have prompted some shippers to rethink the efficiency by which a mail piece is delivered through the USPS or even other common carriers. One of the most effective solutions for increasing the efficiency of, and reducing the cost of, delivering a mail piece is automating the process of sorting and handling the mail. However, there are strict USPS rules that must be followed in order for a piece of mail to be considered an automated flat mail piece.

In accordance with the present invention, there is provided an automated flat mail piece comprising a bendable envelope and a bendable insert tray that satisfies USPS requirements for an automated flat. The bendable envelope comprises a generally rectangular and symmetrical two-panel envelope with a sealable opening at one or both transverse edges. The envelope has two flat surfaces delineated by score lines offset from the envelope edges. The flat surfaces taper to pointed edges of the envelope edges. The envelope additionally has at least one score line, but preferably, a set of three bend-enabling equally spaced score lines disposed centrally from one transverse edge to the opposing transverse edge and also centrally from one longitudinal edge to the opposing longitudinal edge. There is provided an additional score line that intersects an envelope edge and an outermost of the set of three score lines and extends diagonally from the envelope edge to intersect the middle of the set of three score lines.

In use, the bendable insert tray is disposed inside the cavity of the aforementioned bendable envelope. The bendable insert tray comprises a generally rectangular structure having two longitudinal and two transverse edges. There is a rectangular base with a perforated line disposed centrally from each edge to its respective opposing edge, thus dividing the base into four segments. Each of the two longitudinal edges has a flap forming part of the upper insert tray lip and aligned in the longitudinal direction. Each flap has two curved exterior corners and two triangular cutouts centrally disposed widthwise across the flap with their apexes connected by a perforated score line. Each flap is integrally connected to the base by two walls extending at substantially right angle from the base. Each of the two transverse edges has a flap forming part of the upper insert tray lip aligned in the transverse direction. The flap has two curved exterior corners and two triangular cutouts centrally disposed widthwise across the flap with their apexes connected by a perforated line. The flap is connected to the base by two walls extending at substantially right angle from the base. When disposed in the envelope, the exterior edges of the insert tray's flaps preferably are contacting and aligned with the envelope's interior longitudinal and transverse edges.

In one embodiment, a mail piece is made of a card stock coated at least on one side (used as the exterior surface of the envelope) and of thickness ranging from 8 points to 30 points. In another embodiment, a mail piece is made of a non-coated card stock.

In one embodiment, the score lines on the envelope and the insert tray are scored lines. In another embodiment, the score lines on the envelope are scored lines and the score lines on the insert tray are perforated lines. In yet another embodiment, the score lines on the envelope are scored lines and the score lines on the insert tray are a combination of perforated and scored lines.

It is an object of the present invention to provide a mail piece that satisfies USPS requirements for an automated flat.

It is another object of the present invention to provide a mail piece having two parts: a bendable envelope and a bendable insert tray.

It is another object of the present invention to provide a mail piece that is reusable and/or recyclable.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification. These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
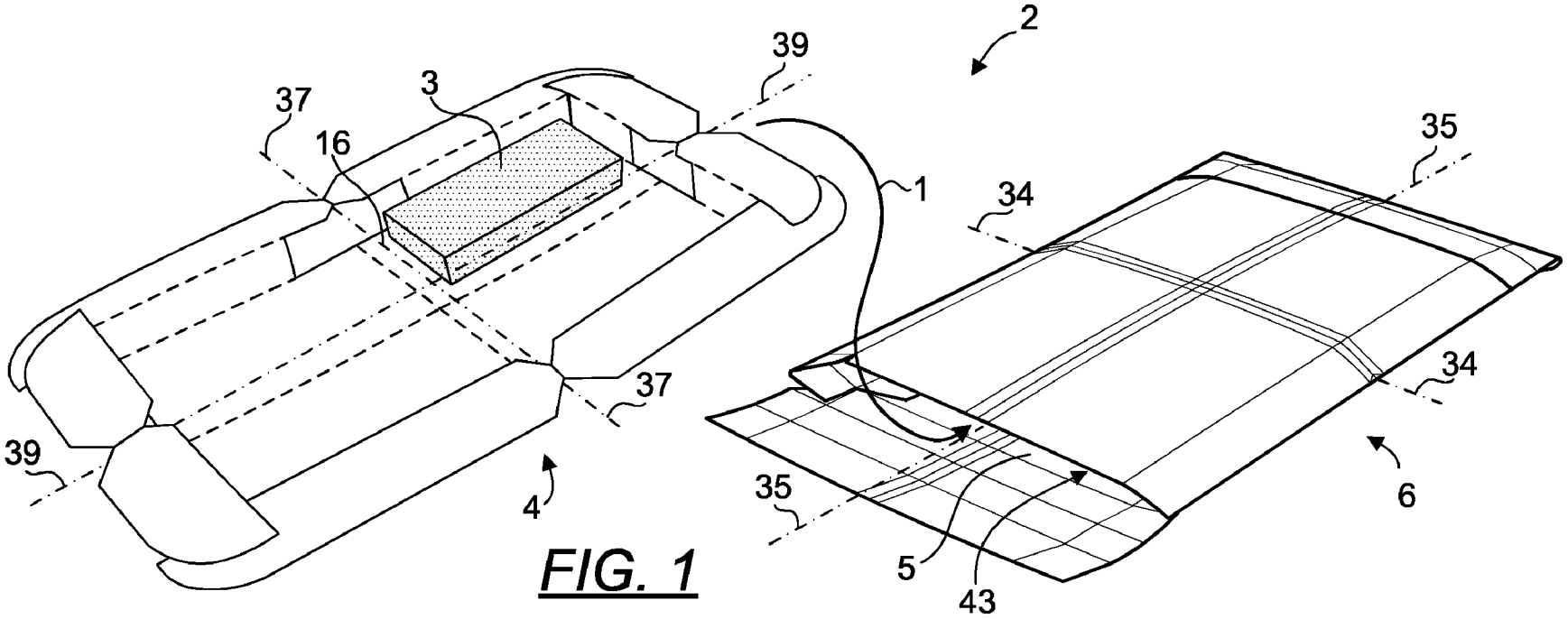
FIG. 1 is a perspective view of an automated flat mail piece of the present invention.

The drawings are not to scale, in fact, some aspects have been emphasized for a better illustration and understanding of the written description.

PARTS LIST

1—direction insert tray is stuffed into an envelope
2—automated flat mail piece
3—article being shipped
4—bendable insert tray
5—removably sealable edge (opening) of bendable envelope
6—automated flat bendable envelope
8—transverse elongated flap
9—erected tray width
10—longitudinal elongated flap
11—erected tray length
12—longitudinal tray wall (thickness providing wall)
13—assembled mail piece (stuffed envelope) thickness
14—transverse tray wall (thickness providing wall)
15—clearance between article and tray base score line in the transverse direction
16—tray base
17—clearance between article and tray base score line in the longitudinal direction
18—curved edge on transverse elongated flap
20—curved edge on longitudinal elongated flap
22—bend-enabling cutout in transverse flap
24—bend-enabling score line (bend enabling band) in transverse elongated flap
26—bend-enabling cutout in transverse elongated flap
28—bend-enabling cutout in longitudinal elongated flap
30—bend-enabling score line (bend enabling band) in longitudinal elongated flap
32—bend-enabling cutout in longitudinal elongated flap
34—longitudinal bend axis of bendable envelope
35—transverse bend axis of bendable envelope
36—score lines enabling tray wall and flap to be erected (insert tray bend enabling band)
37—longitudinal bend axis of bendable insert tray
38*a*—score lines enabling tray base to bend in longitudinal direction (insert tray bend enabling band)
38*b*—score lines enabling tray base to bend in transverse direction (insert tray bend enabling band)
39—transverse bend axis of bendable insert tray
40—flex-enabling cut
41—flatness providing surface of bendable envelope (flat portion)
42—envelope flap
43—cavity of bendable envelope
44—score lines enabling envelope to bend (bend enabling band)
45—envelope flap score line (envelope bend enabling band)
46—stress relief score lines (envelope bend enabling band)
47—panel of bendable envelope
48—score lines enabling slope transition of envelope flat to envelope edges (slope transition enabling band)
49—mouth of bendable insert tray
50—score line forming envelope longitudinal edge
51—portion of bendable envelope forming bottom panel and the end closure flaps
52—score line forming bendable envelope side overlap flap
53—portion of bendable envelope forming top panel
54—score lines forming bendable envelope end overlap flap
55—periphery of base
56—score lines forming bendable envelope flap
57—tapered portion
58—envelope end overlap flap
60—envelope side overlap flap
62—diagram illustrating the effect of bend in the bendable envelope depicted in FIGS. 1-6B
64—diagram illustrating the effect of bend in conventional prior art mail piece
65—envelope convex bend angle
66—crease concave angle of in the bendable envelope depicted in FIGS. 1-6B
67—crease
68—crease concave angle of prior art configuration
70—crease surface on one side of crease
72—crease surface on another side of crease
74—bendable envelope longitudinal edge (pointed edge)
75—bendable envelope transverse edge (pointed edge)
76—convex surface of bend
78—concave surface of bend
80—surface segments developed about envelope edge
84—cutout type article holder

86—cutout of the cutout type article holder (attachment point)
88—erected cutout type article holder (attachment point)
90—loop type article holder (attachment point)
92—erected loop type article holder (attachment point)
94—article secured using a cutout type article holder
96—article secured using a loop type article holder
98, 100, 102, 104—a segment of the bendable insert tray base
106—roller
108—bend amount of mail piece
110—bend of mail piece
112—leading or trailing edge of mail piece
114—height of tray wall
116—mail piece's travel direction

PARTICULAR ADVANTAGES OF THE INVENTION

There is provided a novel and previously unknown mail piece that is automated flat due to its substantially consistent thickness resulting from an erected insert tray disposed in the cavity of a mating envelope. By providing score lines on the envelope, around the periphery of the insert tray mouth and around the insert tray base, the flatness and thickness of the mail piece can be maintained. The tray's flared flaps aligning with the interior edges of the envelope, in combination with the insert tray's thickness-providing walls, provides structural rigidity to the mail piece. Thus, the mail piece both exhibits sufficient bendability to satisfy postal regulations and sufficient structural integrity to protect its contents.

The mail piece is able to negotiate bends without breaking apart or getting stuck in a mail processing unit via its combination of stress deflecting and absorbing score lines and cutouts that make it bendable. A segmented inserted tray base allows an article to be positioned away from the insert tray bend.

When an external force is applied to the outer surfaces of the envelope, insert tray thickness-providing walls have a tendency to deflect this force by rotating in the outwardly or inwardly direction with respect to the tray base with the flaps aiding in limiting or cushioning the rotation of the walls. When rotating outwardly, the walls cause the flaps to push outwardly to contact the interior edges of the envelope, making the envelope tauter thereby reducing the thickness of the envelope. When rotating inwardly, the walls cause the flaps to pull away from the interior edges of the envelope, relaxing the pressure exerted on the envelope, thereby reducing the thickness of the envelope. The beam strength of the envelope and insert tray is sized such that the thickness variation of a stuffed envelope is maintained within ¼ inch at all times.

DETAILED DESCRIPTION OF A PREFERRED EMBODIMENT

With reference to the various figures, an automated flat mail piece 2 ("mail piece") in accordance with the present invention is disclosed. Broadly speaking, and referring to FIG. 1, the mail piece 2 comprises a bendable envelope 6 and a bendable insert tray 4 centrally placeable in the cavity 43 of the bendable envelope 6 to form an assembled mail piece 2. At least one edge of the bendable envelope is removably sealable to facilitate loading and/or unloading of the package contents. FIG. 1 is a perspective view of the automated flat mail piece 2 comprising a bendable envelope 6 and a bendable insert tray 4 stuffed in the bendable envelope 6. The article 3 being mailed is secured to the base 16 of the insert tray 4 by hot melt, wafer seal, adhesive tape or other adhesive materials at an attachment point or by means of an attachment point formed by a cut made in the base 16. The mailed article 3 can be adhered directly to the insert tray base 16 or it can be enclosed in a bag with the bag adhered or secured to the insert tray base 16 at the attachment point. To assemble the mail piece 2, the insert tray 4 with the article 3 is stuffed via a removably sealable edge, preferably the envelope opening 5, in the direction 1 indicated. When the bendable insert tray 4 is disposed in the bendable envelope 4 to form said assembled mail piece 2, the bendable insert tray 4 has a transverse bend axis 39 that is substantially co-linear to the bendable envelope's transverse bend axis 35 and a longitudinal bend axis 37 substantially co-linear to the bendable envelope's longitudinal bend axis 34. Thus, the two components cooperate to allow bending of the assembled mail piece at predetermined points.

As will be appreciated, other ways of securing the article 3 into the insert tray may be suitably adapted and are considered within the scope of the present invention. For example, various tie arrangements or other mechanical fasteners may be employed in addition to or in lieu of the adhesive. A molded plastic sheet may be adhered to the insert tray base 16 to secure the article thereunder, or secured to another cardboard piece that is laid into the insert tray base 16. As described in detail with respect to FIG. 8, one or more cutout article holders may also be used in lieu of or in addition to the adhesive or mechanical fastening.

Figure 1A:
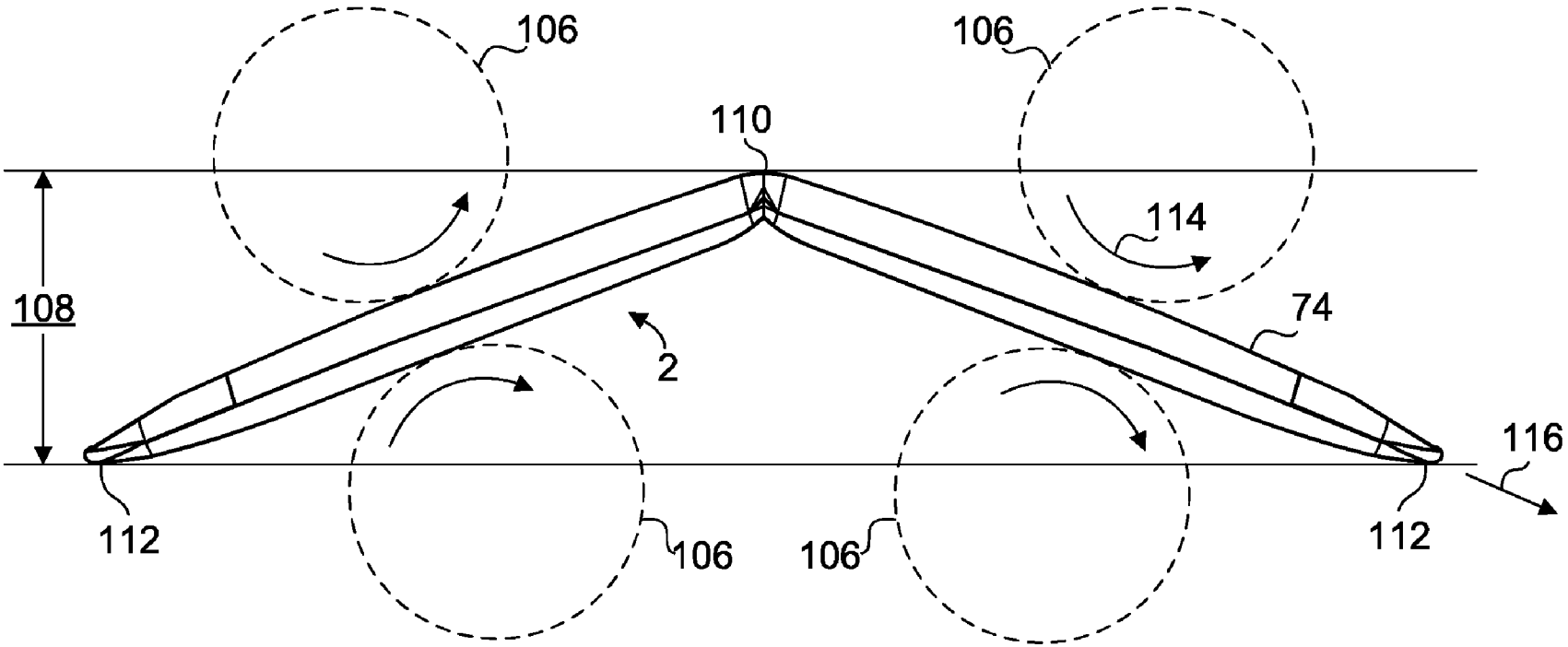
FIG. 1A is a side orthogonal view of an automated flat mail piece of the present invention negotiating a bend.

FIG. 1A is a side orthogonal view of an automated flat mail piece 2 negotiating a bend in the path of a mail processing machine. While being processed, an automated flat mail piece 2 is typically fed with its longitudinal or transverse edges aligned with the direction of travel 116. Two pairs of drive rollers are shown, one disposed on the upstream and the other on the downstream of the bend. As depicted, an automated flat mail piece 2 is arranged with its longitudinal edges 74 aligned with the travel direction 116 and the drive rollers 106 rotate in direction 114, causing the mail piece 2 to travel in the direction 116. As the mail piece 2 negotiates the bend, the mail piece 2 forms a bend 110 at substantially midpoint in the lengthwise direction of travel. The amount of bend 108 allowed for an automated flat mail piece by the USPS is limited to two inches in the longitudinal or transverse direction. The novel mail piece 2 of the present invention enables bending but the amount of bend is limited to the allowance provided by the USPS.

Figures 2A, 2B:
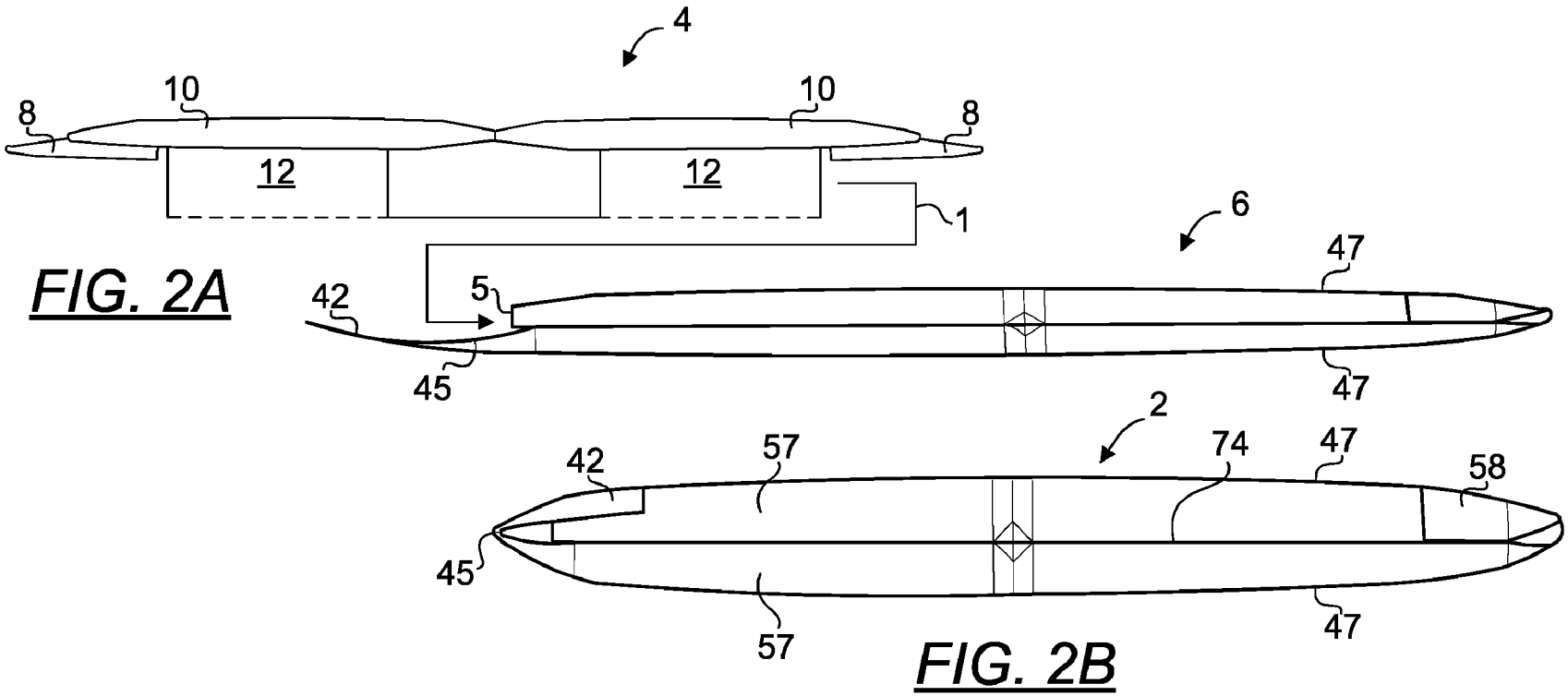
FIG. 2A is a side orthogonal view of an automated flat mail piece of the present invention.
FIG. 2B is a side orthogonal view of a stuffed automated flat mail piece of the present invention.

FIG. 2A is a side orthogonal view of an automated flat mail piece 2 of the present invention. When erected, the bendable insert tray 4 comprises longitudinal and transverse (not visible) walls 12, 14 and longitudinal 10 and transverse 8 elongated flaps. The insert tray walls are thickness providing walls that function to maintain a consistent thickness of the assembled mail piece 2 during use such that the thickness is maintained at from 0.25 inch to 0.75 inch and does not vary or deflect by more than 0.25 inch when subjected to a transport belt tension of 40 pounds around an 11 inch diameter turn during automated mail processing.

After being loaded with the article to be shipped, the bendable insert tray 4 is stuffed into the bendable envelope 6 via the envelope opening 5 in the direction 1 indicated. FIG. 2A shows a mail piece 2 bendable envelope 6 in the unstuffed state with the envelope flap 42 open and FIG. 2B is a side orthogonal view of a stuffed and assembled mail piece 2 in the sealed position. As depicted in FIG. 2A, a score line 45 is shown disposed at the envelope opening 5 to facilitate closing of the envelope flap 42 over the opening 5. Typically hot melt, adhesives or adhesive tape is applied to secure the envelope flap 42 to the flat surface of the envelope to place the mail piece 2 in the sealed position.

Figure 3A:
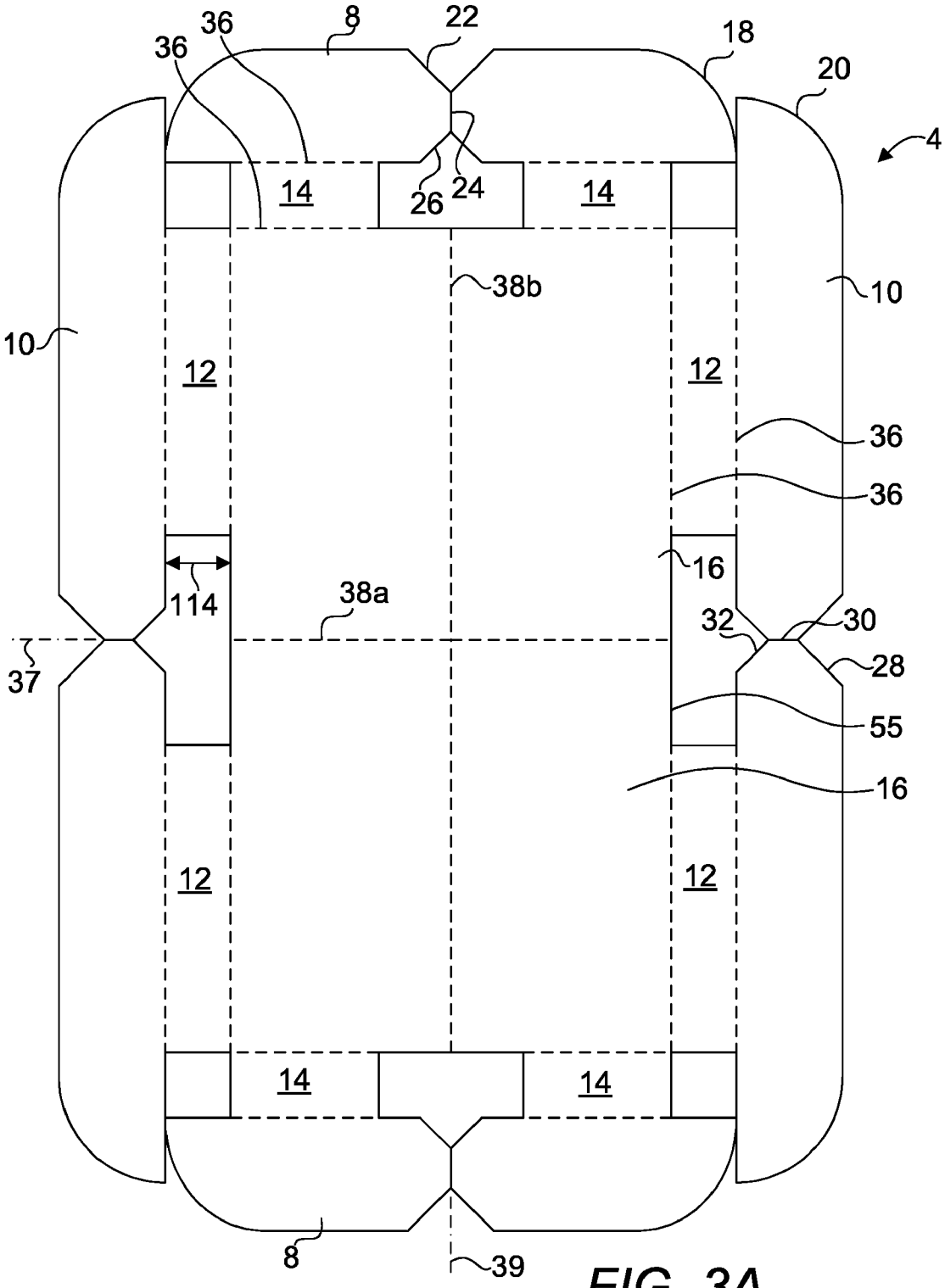
FIG. 3A is a top orthogonal view of an unerected insert tray of the present invention.

FIG. 3A is a top orthogonal view of an unerected bendable insert tray 4. In the configuration depicted, an insert tray 4 is cut out of a flat sheet of paper or cardboard stock using a die-cut process. A card stock in the range of 8-30 points is well suited to this application. The insert tray 4 has a generally rectangular shape and has an elongated flap 8, 10 on the periphery of each of its four edges. There is at least one tray wall 14, 12 extending from each flap 8, 10 inwardly towards a common base. In the embodiment depicted, there are provided two tray walls for each elongated flap, totaling eight tray walls 12, 14 including four longitudinal tray walls 12 and four transverse tray walls 14. The height 114 of a tray wall 12, 14 is defined as the shortest distance between two adjacent score lines 36. A tray wall 12, 14 is preferably configured to substantially convey the thickness of an automated mail piece 2 and therefore the tray wall height 114 shall range substantially from 0.25 inch to 0.75 inch.

A longitudinal elongated flap 10 is formed on each longitudinal edge of the insert tray 4. As will be described elsewhere herein, the flap 10 extends substantially perpendicularly outwardly from an edge of the insert tray mouth 49. Each longitudinal flap 10 is formed by an elongated sheet member having a curved periphery on each of its external corners 20, a triangular shaped cutout 28 at the central outside edge (in the lengthwise direction), a triangular shaped cutout 32 at the central inside edge (in the lengthwise direction), and a flap bend-enabling score line 30 connecting the apex of the two triangular shaped cutouts 28, 32. The flap bend enabling score line 30 functions as a flap bend enabling band and is substantially parallel to the insert tray bend enabling band 38*a* such that they cooperatively function to allow bending of the assembled mail piece 2. As will be readily appreciated, the flap bend enabling band 30 may comprise features other than score lines and/or cutouts. The opening of the triangular shaped cutouts is disposed on the inside (e.g. inner) and outside (e.g. outer) longitudinal edges of the elongated flap 10.

A transverse flap 8 is formed on each transverse edge of the insert tray 4. As will be described elsewhere herein, the flap 8 extends substantially perpendicularly outwardly from an edge of the insert tray mouth 49. Each transverse flap 8 comprises an elongated sheet member having a curved periphery on each of its external corners 18, a triangular shaped cutout 22 at the central outside edge, a triangular shaped cutout 26 at the central inside edge, and a flap bend-enabling score line 24 connecting the apex of the two triangular shaped cutouts 22, 26. The flap bend enabling score line 24 functions as a flap bend enabling band and is substantially parallel to the insert tray bend enabling band 38*b* such that they cooperatively function to allow bending of the assembled mail piece 2. As will be readily appreciated, the flap bend enabling band 24 may comprise features other than score lines and/or cutouts. The opening of the triangular shaped cutouts is disposed on the inside (e.g. inner) and outside (e.g. outer) transverse edges of the elongated flap 8.

Each elongated flap 8, 10 is disposed in a plane substantially parallel to a plane of the base 16, substantially aligned lengthwise to one of the longitudinal or transverse edges of the base 16, and rotatably connected to and supported by two thickness providing walls 14, 12 at the inner longitudinal edge and comprises a flap bend enabling band 24, 30 substantially centrally disposed and extending from the inner longitudinal edge to the outer longitudinal edge.

Referring to FIG. 3A, a tray base 16 is provided on which an article is attached for shipping. The insert tray base 16 comprises two score lines 38*a*, 38*b* that cross at right angle, partitioning the tray base 16 into four equal segments. In order to provide structural integrity to the envelope 6 in which the insert tray 4 is placed, one tray wall (12 or 14) is formed to connect each segment to its corresponding flap. For example, tray wall 12 connects a segment of the tray base 16 to a longitudinal flap 10 with score lines 36 parallel to the lengthwise axis of the flap 10. Similarly, tray wall 14 connects a segment of the tray base 16 to its corresponding transverse flap 8 with score lines 36 parallel to the lengthwise axis with the flap 8. These score lines 36 function as stress relief bands. It is to be appreciated that other means of stress relief may be suitably used for the stress relief bands.

Figure 3B:
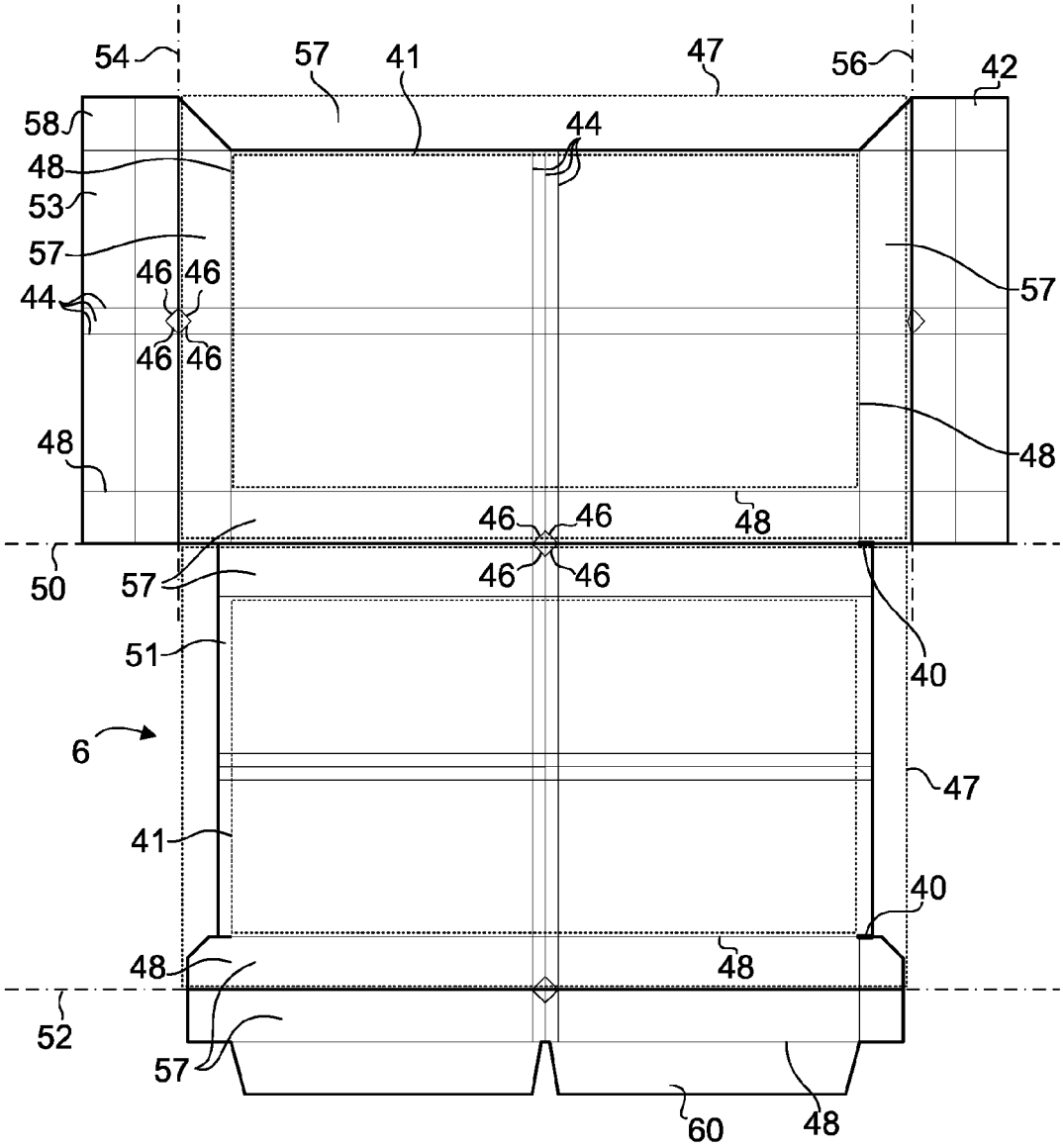
FIG. 3B is a top orthogonal view of an unerected envelope of the present invention.

FIG. 3B is a top orthogonal view of an unerected bendable envelope 6. In the configuration depicted, an envelope 6 is cut out of a flat sheet of paper, cardboard or card stock using a die-cut process. A card stock in the range of 8-30 points is well suited to this application. In this configuration, the envelope 6 comprises two opposing and generally rectangular planar panels 47 joined at three edges (for example, two longitudinal edges and one transverse edge), a removably sealable opening at the opposing transverse edge to receive the insert tray 4, and a flap 42 that closes and retains the contents of the envelope 6. As will be appreciated, the envelope 6 may be fixedly joined (sealed) at only the two longitudinal edges, leaving both transverse edges removably joinable and open for loading the insert tray. As will be further appreciated, the envelope 6 may be fixedly joined (sealed) at the two transverse edges and removably joinable (sealable) at one of the longitudinal edges. The remaining longitudinal edge may be fixedly or removably sealable as desired or convenient for the user.

Referring to FIG. 3B, the envelope 6 is made up of two generally rectangular portions 51 and 53. Portion 53 is a combination of an envelope flap 42, a top panel 47 of the envelope and an envelope end overlap flap 58. Portion 51 is a combination of a bottom panel 47 of the envelope 6 and an envelope side overlap flap 60. In erecting the envelope 6, a 180-degree score is made along score line 52 to form envelope side overlap flap 60. A 180-degree score is made along score line 54 to form envelope end overlap flap 58. A 180-degree score is made along score line 56 to form envelope flap 42 and a 180-degree score is made along score line 50 to biscore the envelope into its final shape. In this configuration, the envelope end overlap flap 58 and envelope side overlap flap 60 are affixed to their respective opposing panels 47 using adhesives. The means of affixing two sheets of paper with adhesives is well known in the art.

The envelope 6 further comprises bend-enabling score lines 44, stress relief score lines 46 and slope transition-enabling score lines 48. These score lines function as bend enabling bands and slope transition enabling bands. It is to be appreciated that other means of enabling bending and slope transition of the envelope may be suitably used for the bend enabling and slope transition enabling bands. Bend-enabling score lines 44 are disposed at a location where a bend is expected or desired to develop. In this configuration, a set of three equally spaced bend-enabling score lines 44 are centrally disposed from the longitudinal ends of the envelope and another set of three equally spaced bend-enabling score lines 44 are centrally disposed from the transverse ends of the envelope. The three bend-enabling score lines are preferably spaced apart from 3/16 inch to ½ inch. A stress relief score line 46 is disposed diagonally extending from each outermost bend-enabling score line 44 commencing at an envelope edge to a middle bend-enabling score line 44 to form V-shaped configuration. Referring again to FIGS. 2B and 3B, when the envelope is stuffed, a slope transition-enabling score line 48 is provided to ease the transition of the envelope surface from flat as delineated and enclosed by score lines 48 to the tapered surface areas 57 outside of this flat surface 41. This enables bending of the panel 47 about an axis substantially coaxial to the middle of the three equally spaced score lines 44.

Referring to FIGS. 3A and 3B, this flat surface 41 is additionally maintained by the structure of the bendable insert tray. As will be described elsewhere herein, the generally rectangular shaped mouth 49 and base 16 of the insert tray 4 correspond to the rectangular flat surface 41, and in cooperation with the insert tray walls 12, 14, maintain this flatness of the panels 47 during automated mail processing and other bending during handling and use. The thickness providing walls 12, 14 are perpendicularly disposed to the flatness-providing surfaces 41 and a periphery of one of the flatness-providing surfaces 41 is disposed in substantial conformance with the periphery of the insert tray mouth 49, and a periphery of another one of the flatness-providing surfaces 41 is disposed in substantial conformance with the periphery 55 of the base.

In one aspect, the score lines are variable depth score lines such that the depth of the score is deeper in some portions, creating a perforation effect in the score line. This perforated line is particularly useful for the longitudinal and transverse tray bend enabling bands 38*a*, 38*b* and flap bend enabling bands 30, 24.

Figure 4A:
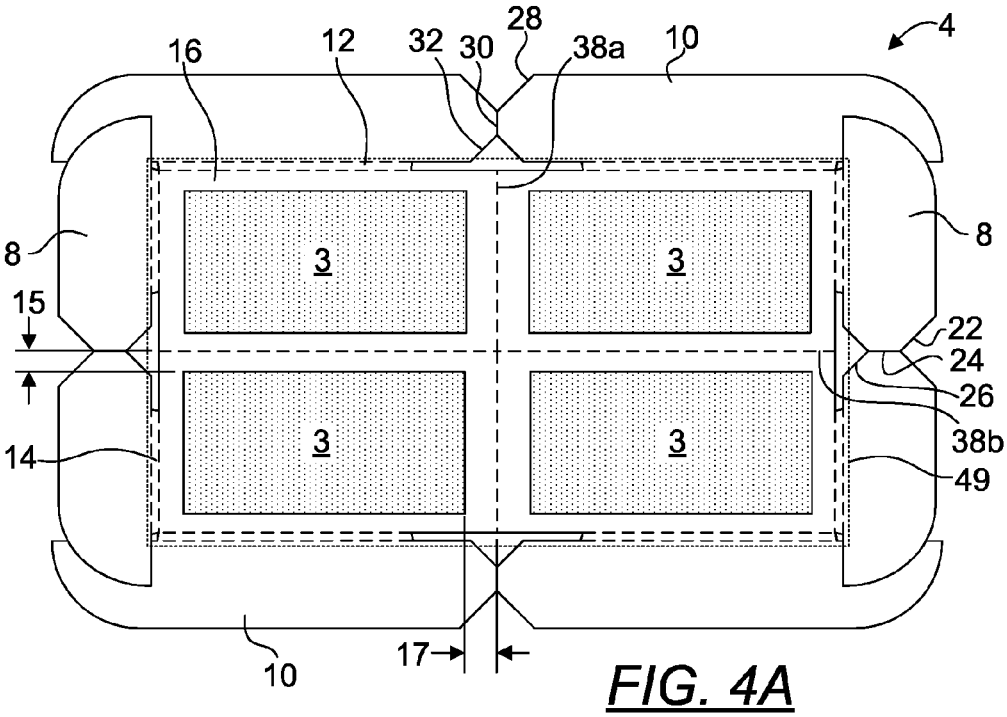
FIG. 4A is a top orthogonal view of an erected insert tray with four articles positioned on the insert tray of the present invention.

FIG. 4A is a top orthogonal view of an erected insert tray 4 with four articles 3 positioned on the insert tray 16. An article 3 is positioned such that sufficient clearance 15, 17 is maintained between the article and the tray base score lines 38*a*, 38*b* disposed substantially on the longitudinal and transverse bend axes 37, 39 to enable bending of the insert tray 4 in the longitudinal and transverse direction and avoid the article obstructing the freedom of movement or rotation at these bend axes 37, 39. As will be apparent, the longitudinal and transverse bend axes 34, 35, 37, 39 of both the bendable envelope and bendable insert tray are substantially perpendicular to one another.

Referring to FIG. 4A, the transverse flaps 8 rest on top of the longitudinal flaps 10. As will be readily appreciated, it is structurally equivalent to have the inverse, that is, the longitudinal flaps 10 rest on top of the transverse flaps 8. When stuffed in an envelope, tray walls 12, 14 are positioned at substantially perpendicular to and upwardly from the at the periphery of the insert tray base 16 such that the insert tray walls 12, 14 form a mouth 49. The structural rigidity of the insert tray 4 is provided by keeping the insert tray 4 in snug contacting engagement with the interior surfaces of the envelope cavity 43. A snug contact is established when the transverse tray walls 14 come in contact with longitudinal tray walls 12 and when the exterior edges of transverse and longitudinal flaps 8, 10 come in contact with the interior edges of the envelope cavity 43.

In addition to permitting bending of the insert tray 4 along a score line 38*b*, 38*a*, a score line 24, 30 allows limited relative twisting of a flap 8, 10 about the score line 24, 30, thereby enabling a flap 8, 10 to deflect a perpendicularly applied force to one end of the flap 8, 10. A cutout disposed at each terminal end of the score lines further allows twisting of the insert tray and elongated flap.

Figure 4B:
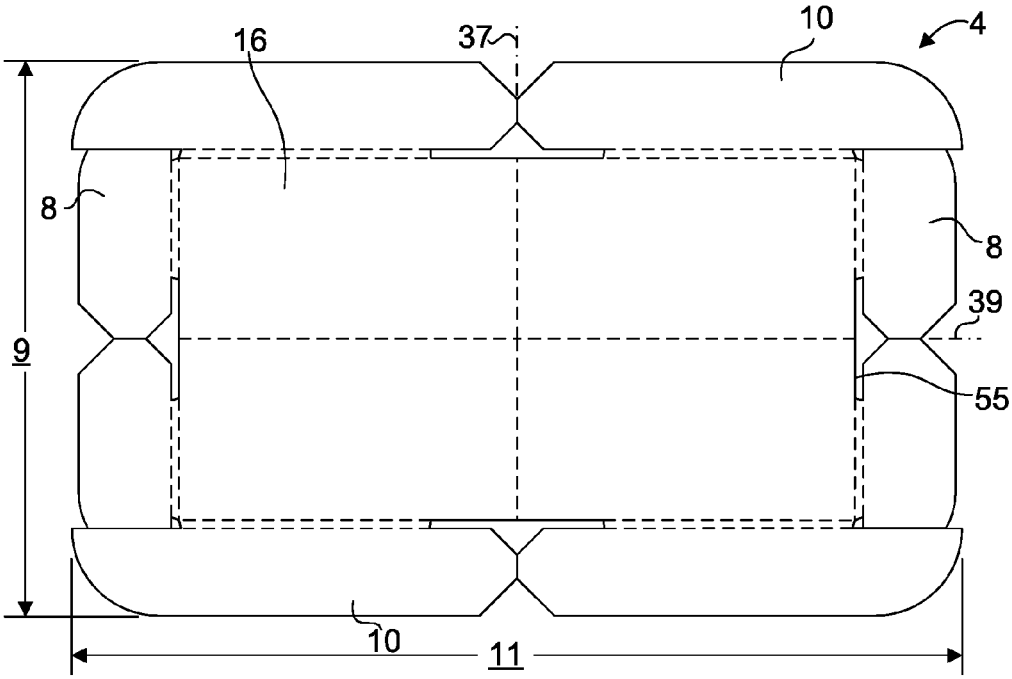
FIG. 4B is a bottom orthogonal view of an erected insert tray of the present invention.

FIG. 4B is a bottom orthogonal view of an erected insert tray 4. The insert tray 4 is sized to accommodate an article and to fit snugly inside an envelope 6. Therefore, a typical envelope 6 of the present invention will require that the outer periphery of the flaps 8, 10 of an erected tray 4 be substantially the same as interior periphery of the envelope's cavity 43. Current envelope sizes of the present invention are 6½ inches by 5½ inches, 9 inches by 6⅜ inches, 10½ inches by 6⅜ inches, 12½ inches by 7¼ inches, 14½ inches by 8¾ inches and 14½ inches by 11½ inches while their corresponding tray base sizes are 3¾ inches by 3⅞ inches, 6¼ inches by 4¾ inches, 7 13/16 inches by 4 11/16 inches, 9¾ inches by 5⅝ inches, 11¾ inches by 7 inches and 11¾ inches by 9⅞ inches. It should be noted that various other envelope and sizes may also be used provided that their dimensions fall within the constraints imposed by the USPS of from 6 inches by 5 inches to 15 inches by 12 inches.

Figure 5A:
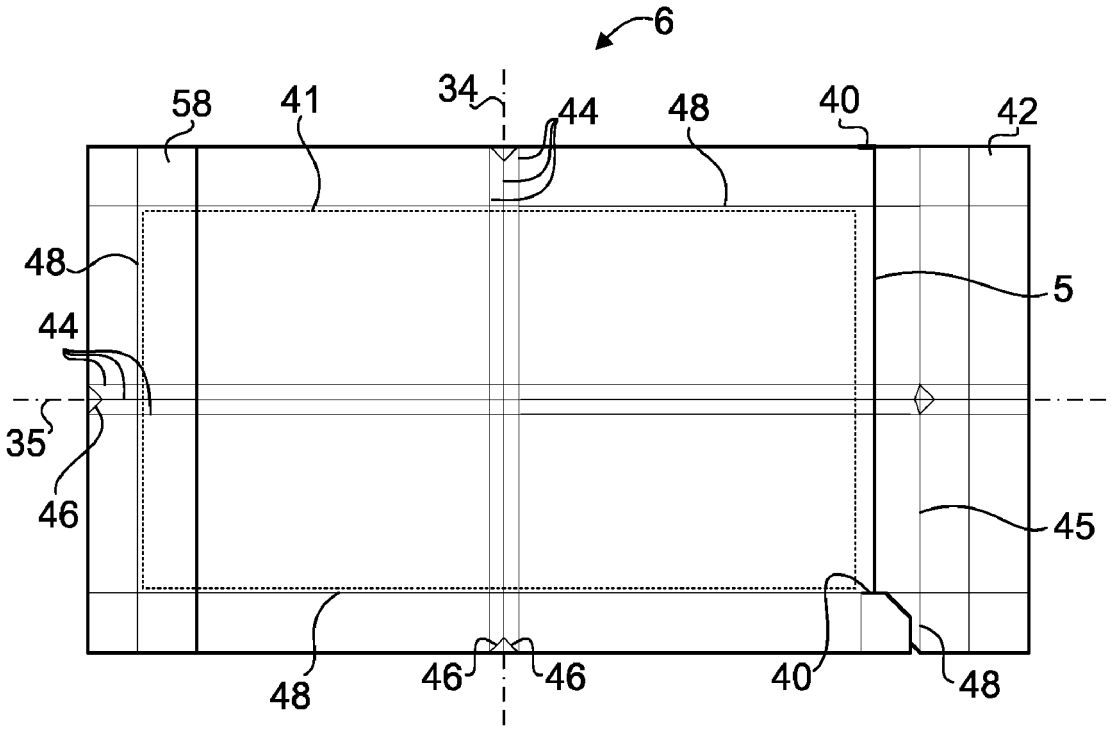
FIG. 5A is a top orthogonal view of an erected but unsealed envelope of the present invention.

FIG. 5A is a top orthogonal view of an erected but unsealed envelope 6. While being processed at a mail facility, the envelope is expected to face various curved and straight travel paths and experience external forces exerted upon it. In order to negotiate a curved travel path, the envelope is expected to be capable of being bent and compliant with the path. A set of three bend-enabling score lines 44 is provided and disposed substantially co-linear with the longitudinal bend axis 34 of the envelope to enable lengthwise bending of the envelope 6. A set of three bend-enabling score lines 44 is also provided and disposed substantially co-linear with the transverse bend axis 35 of the envelope 6 to enable widthwise bending of the envelope 6.

In addition, diagonal stress relief score lines 46 are provided to cooperate with bend enabling score lines 44 to lessen the effects of a crease that may develop when the envelope 6 is bent. A stress relief score line 46 is disposed diagonally extending from an outer bend-enabling score line 44 at an envelope edge to a middle bend-enabling score line 44. When the envelope is stuffed, a slope transition-enabling score line 48 disposed parallel to, but offset from, each edge of the envelope 6 is provided to ease the transition of an envelope surface from flat 41 as delineated and enclosed by score lines 48 to the surface areas 57 outside of this flat surface and bounded by the edges of the envelope 6.

An envelope flap 42 is provided to secure the contents of the envelope 6 and also to keep the contents under snug fit. A snug fit is established when an insert tray 4 is inserted into the envelope's cavity 43 with one end of the insert tray extremity coming in contacting abutment with score line 45 to facilitate closing of the envelope flap 42 over the opening 5 to seal the envelope 6. In addition, a pair of flex-enabling cuts 40 is provided to make closing of the envelope flap 42 easier. The envelope end overlap flap 58 is affixed to the top panel 47 of the envelope 6 using adhesives.

Figure 5B:
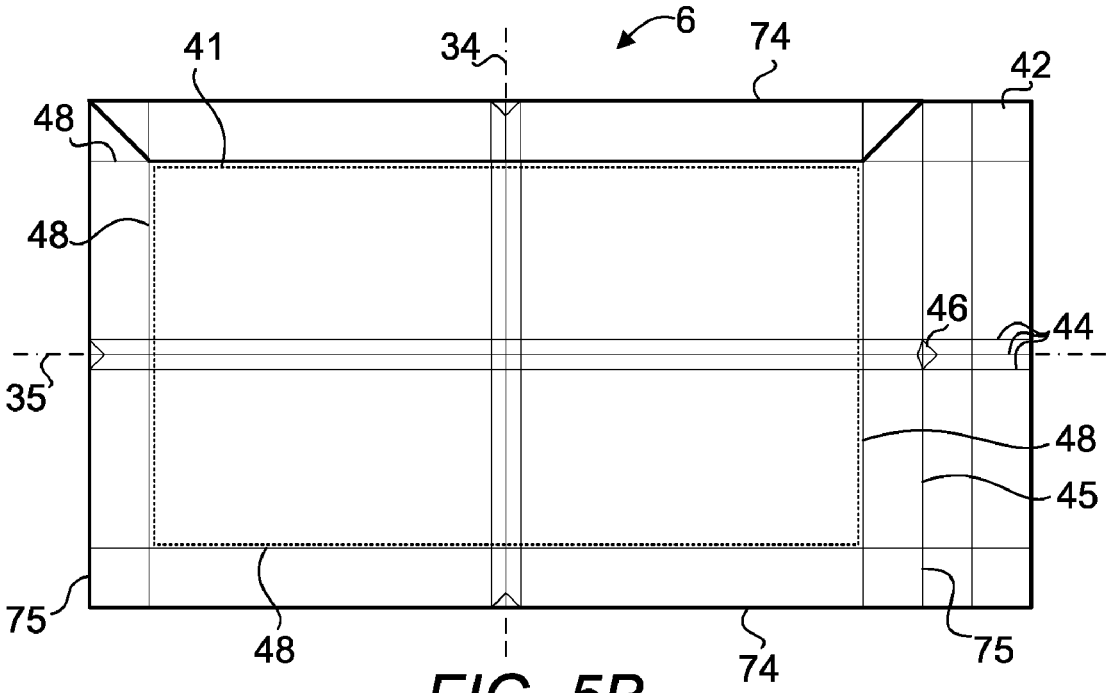
FIG. 5B is a bottom orthogonal view of an erected but unsealed envelope of the present invention.

FIG. 5B is a bottom orthogonal view of an erected but unsealed envelope 6. Similar to the top panel 47 of the envelope, a set of three bend-enabling score lines 44 is provided and disposed substantially co-linear with the longitudinal bend axis 34 of the envelope to enable lengthwise bending of the envelope 6. A set of three bend-enabling score lines 44 is also provided and disposed substantially co-linear with the transverse bend axis 35 of the envelope to enable widthwise bending of the envelope 6. In addition, diagonal stress relief score lines 46 are provided to cooperate with bend enabling score lines 44 to lessen the effects of a crease that develops when the envelope 6 is bent. A stress relief score line 46 is disposed diagonally extending from an outer bend-enabling score line 44 at the envelope edge to a middle bend-enabling score line 44. When the envelope is stuffed, a slope transition-enabling score line 48 disposed parallel to, but offset from, each edge of the envelope 6 is provided to ease the transition of a substantially flat envelope surface 41 as delineated and enclosed by score lines 48 to the surface areas 57 outside of this flat surface and bounded by the edges 74, 75 of the envelope 6.

Figure 6A:
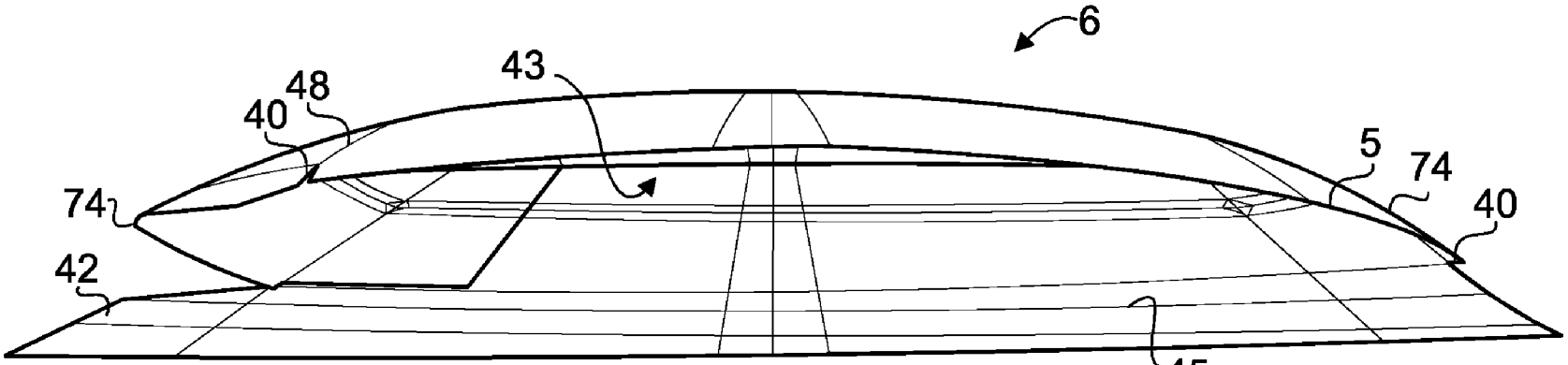
FIG. 6A is a front perspective view of an erected unsealed envelope showing flex-enabling cuts at the mouth of the envelope of the present invention.

FIG. 6A is a front perspective view of an erected unsealed envelope showing flex-enabling cuts 40 at the opening 5 of the envelope 6. A first cut 40 is made co-linear with score line 48 of an envelope edge 74 on the top panel 47 and a second cut 40 is made along the opposing edge 74 of the envelope 6. Upon filling the envelope 6, the envelope flap 42 is rotated along score line 45 to cover the envelope opening 5.

Figure 6B:
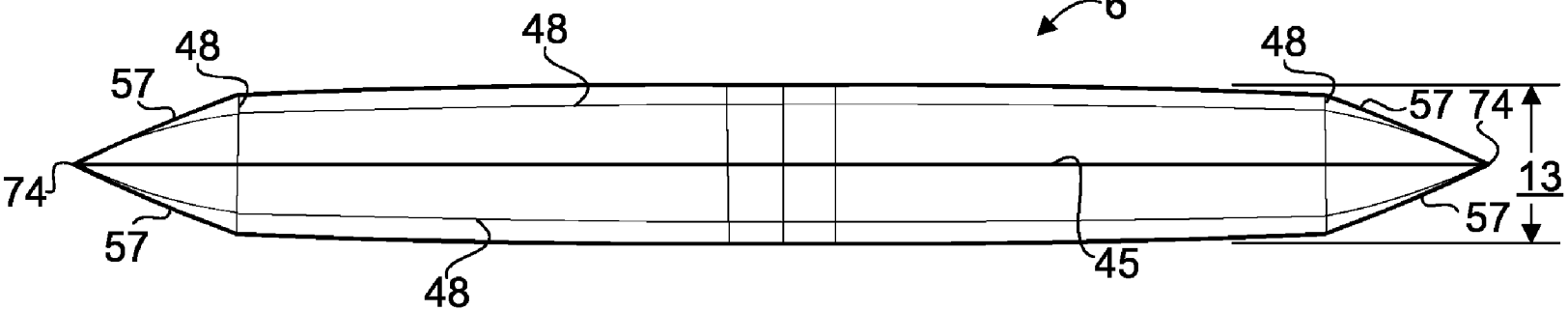
FIG. 6B is a front orthogonal view of a sealed envelope of the present invention.

FIG. 6B is a front orthogonal view of a sealed envelope. The flex-enabling cuts 40 shown in FIG. 6A enable the portion of envelope between the edge 74 and the score lines 48 at the envelope opening 5 to collapse sufficiently when pressed in order for the envelope flap 42 to conform to the contour outside 57 of the flat area delineated by score lines 48. The envelope 6 cooperates with the insert tray 4 to form a stuffed envelope of thickness 13 of from about ¼ inch to ¾ inch. The variation in thickness during mail processing is kept within ¼ inch.

Figure 7A:
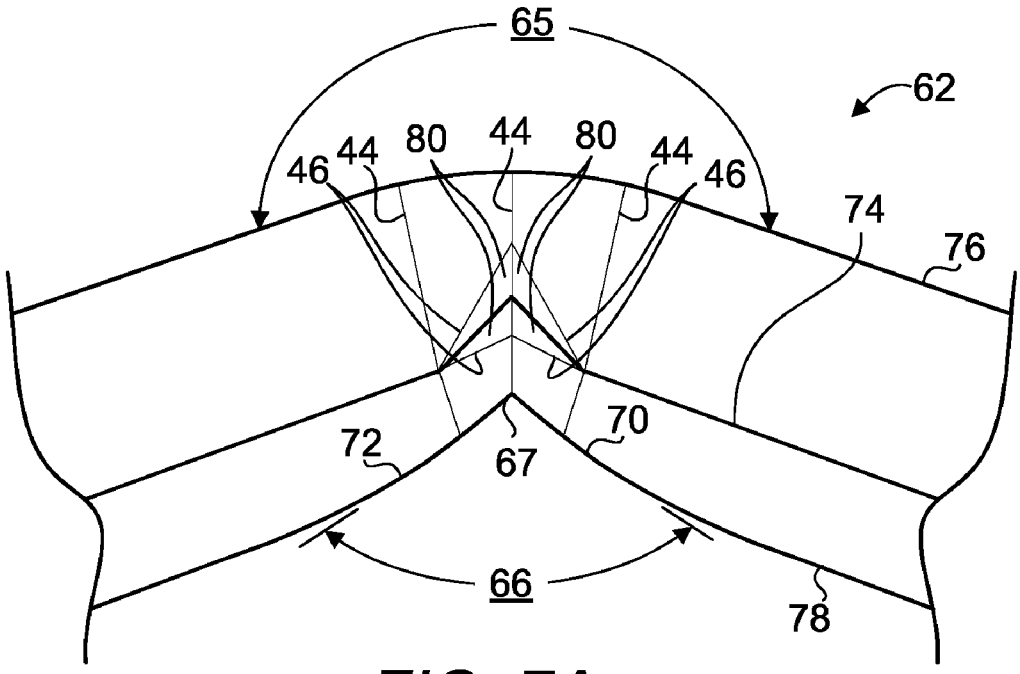
FIG. 7A is a partial side orthogonal view of a bend applied to an mail piece of the present invention.

FIG. 7A is a partial side orthogonal view 62 of a bend applied to a mail piece of the present invention. A convex angle 65 develops on the convex surface 76 of the bend when a bending moment is applied to the envelope 6. A crease 67 having a concave angle 66 as delineated by the crease surfaces 70, 72 is formed on the concave surface 78 of the bend. The bend-enabling score lines 44 and stress relief score lines 46 are lines of weakness and together they cause surface segments 80 to form between the outer score lines 44 on the edge 74 of the envelope 6, resulting in a less severe crease concave angle 66 and less severe damage to the mail piece 2.

Figure 7B:
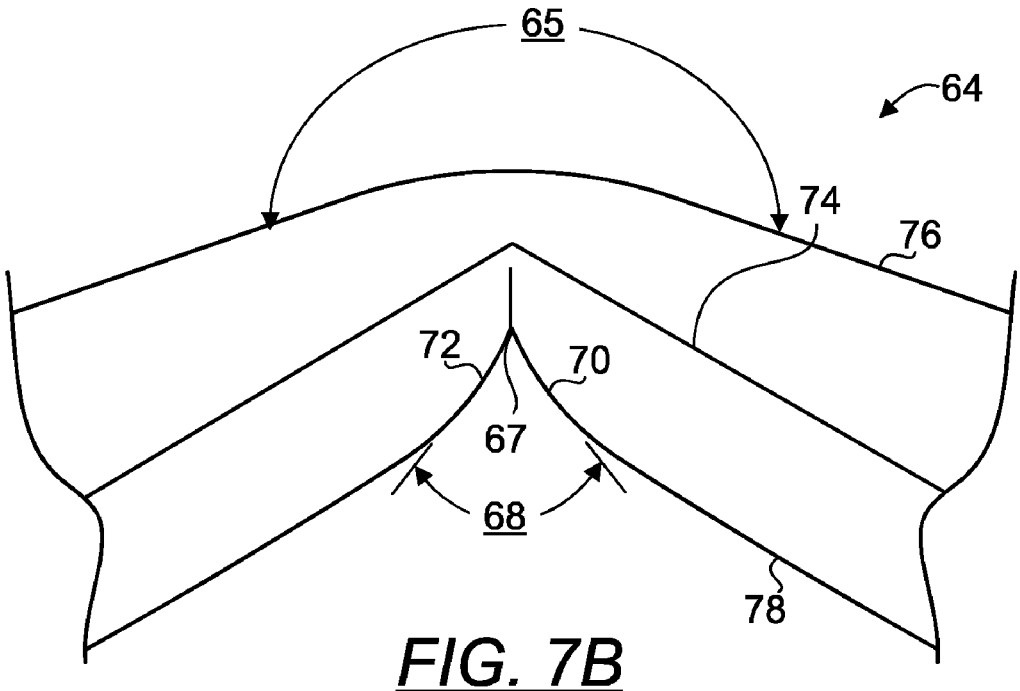
FIG. 7B PRIOR ART
FIG. 7B is a partial side orthogonal view of a bend applied to a conventional mail piece.

FIG. 7B is a partial side orthogonal view 64 of a bend applied to a conventional mail piece 64. A convex angle 65 is developed on the convex surface 76 of the bend when a bending moment is applied to the envelope 6. A crease 67 having a concave angle 68 as delineated by the crease surfaces 70, 72 is formed on the concave surface 78 of the bend. Since the bending moment is not absorbed by the collapse of solitary envelope panel 47 surfaces into various segments as illustrated in FIG. 7A, a more severe crease 67 with a smaller concave angle 68 develops, thereby imparting more severe damage to the envelope and decreasing the reusability of the envelope. A larger bending moment is also required to bend the envelope causing more friction in the envelope processing path and devices, thereby reducing the life span of the equipment.

Figure 8:
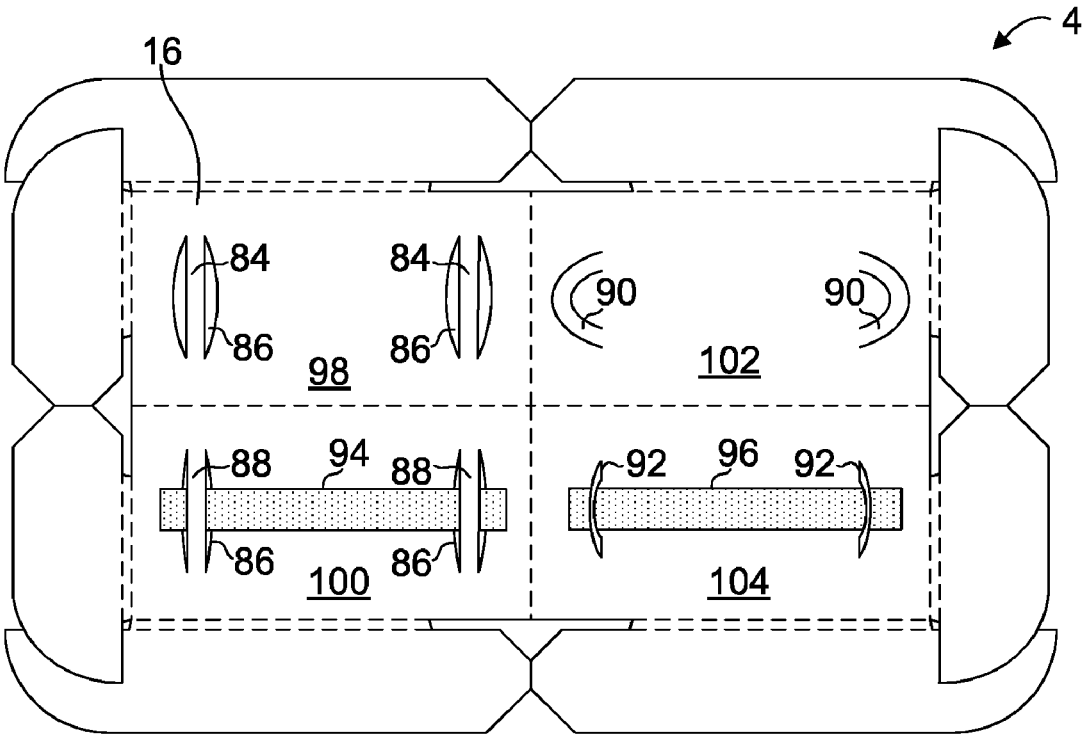
FIG. 8 depicts two embodiments of an article holder formed in the insert tray base of the present invention.

FIG. 8 depicts two embodiments of an article holder 84, 90 formed in the insert tray base 16. In one embodiment 84, a cutout type article holder is shown. Preferably, at least a set of two cutouts 86 is provided, however any number may be used, including only one article holder. As will be readily appreciated, a separate article holder component may be affixed to the tray base in lieu of or in addition to the cutout.

In the embodiment shown in FIG. 8, there are two sets of cutouts 86 with one disposed on one end of segment 98 and another disposed on the opposite end of the same segment 98. In use (as shown in segment 100), an article 94 is inserted through the openings created by the cutouts 86 in the erected cutout type article holder 88.

In another embodiment 90 also depicted in FIG. 8, a loop type article holder is shown. Preferably, at least a set of two through cuts is provided, however any number may be used, including only one article holder. In the embodiment shown, there are two sets of through cuts with one disposed on one end of segment 102 and another disposed on the opposite end of the same segment 102. In use (as shown in segment 104), an article 96 is inserted through the openings created by erecting the strips delineated by the through cuts.

Some of the chief concerns in the design of mail packaging are the recyclability and reusability of the materials used. In one embodiment, a mail piece of the present invention is made of a recyclable paper product. In traditional packaging, a variety of non-recyclable packaging products are used, such as plastic bubble wraps, Styrofoam, packing peanuts, etc. Providing users with non-recyclable materials leave users with no choice but to discard these materials as landfill waste after use. Recyclability is provided with the present novel envelope and insert tray that are bio-degradable.

Traditionally, packaging materials are disposed around an article to prevent damage to the article during shipping. In order to access the article, the packaging materials need to be removed or destroyed rendering the packaging materials non-reusable in most cases. In a preferred configuration, the article is readily removed from the insert tray base by separating the article from the insert tray base. Reusability is solved by providing an envelope and an insert tray capable of withstanding stresses during processing and handling, and especially with the article holder that secures the article in place without the need for additional packing materials. The article holders allow for easy removal of the article by the recipient after shipping. Without damaging the insert tray, the mail piece may be reused for one or more shipments.

The advantages and solutions to problems in the art will now be discussed. As previously set forth, for a mail piece to be considered an automated flat, the following requirements must be met:

(1) the mail piece must bend easily when subjected to a transport belt tension of 40 pounds,
(2) the mail piece must bend easily when travelling around an 11-inch diameter turn,
(3) the mail piece thickness must not be less than 0.25 inch and not exceed 0.75 inch,
(4) the mail piece must have a certain consistent thickness not varying or deflecting by more than ¼ inch,
(5) the mail piece must have a length and width falling within the range of from 6 inches by 5 inches to 15 inches by 12 inches, and
(6) the mail piece must bend by an amount less than two inches in the longitudinal or transverse direction.

The problem of shipping an article in an automated flat envelope and meeting postal automated flat regulation is solved by using a bendable flat envelope having sufficient structural integrity to maintain a consistent envelope thickness and by positioning an article in the envelope such that the envelope remains bendable around curved mail processing paths by securing the article in place away from bend region.

The problem of maintaining a consistent envelope body thickness is solved by placing an erected insert tray in the envelope's cavity 43. The tray provides structural rigidity to the envelope. A flared flap aligned with each interior edge of the envelope, in combination with an envelope thickness-providing insert tray wall, provides the structure of the substantially flat envelope surfaces and maintains a substantially constant thickness at the center portion of the envelope. The thickness only decreases at or tapers to each edge as the envelope transitions from the flatness-providing surfaces to a crease at peripheral edges.

The structural integrity of the envelope is maintained under conditions of regular use, including mail handling and processing activities. When a substantially perpendicular force is applied to the panels, the thickness providing walls rotate outwardly, causing the elongated flaps to push outwardly against the interior of one of the pointed longitudinal edges and pointed transverse edges to tightly draw the bendable envelope, thereby slightly reducing the thickness of the bendable envelope and deflecting the force. When a substantially perpendicular force is applied to the panels, the thickness providing walls rotate inwardly, causing the elongated flaps to pull away from the interior edges of the pointed longitudinal edges and pointed transverse edges, relaxing the pressure exerted on the bendable envelope, thereby slightly reducing the thickness of the bendable envelope and deflecting the force.

In order for the envelope to be able to negotiate bends without breaking apart or getting stuck in a mail processing machine, the envelope must be sufficiently flat, but it must also be bendable. The problem of negotiating bends in the envelope's travel path is solved by providing score lines on the envelope and the insert tray. The score lines on the envelope around the periphery of the insert tray opening and the insert tray base also facilitate the formation of flat surfaces required for machine processing.

The problem of negotiating bends around rollers in the envelope's travel path during machine processing is further solved by providing a segmented inserted tray base on which an article can be positioned away from the insert tray bend regions. Securing the article to the insert tray base prevents the article from detaching from its position and moving into the bend region.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

The invention claimed is:

1. An automated flat mail piece comprising:

a generally rectangular bendable envelope having a cavity defined by two generally rectangular and substantially planar panels having two generally parallel opposingly disposed longitudinal edges and two generally parallel opposingly disposed transverse edges wherein said bendable envelope is sealable on all said longitudinal and transverse edges and a first set of envelope bend enabling bands centrally disposed and perpendicular to said longitudinal edges on each said panel and a second set of envelope bend enabling bands centrally disposed and perpendicular to said transverse edges on each said panel; and a generally rectangular bendable insert tray having a generally rectangular base having two generally parallel opposingly disposed longitudinal edges and two generally parallel opposingly disposed transverse edges, a plurality of walls extending substantially perpendicularly and upwardly from a periphery of said base to cooperatively form a generally rectangular mouth, and four elongated flaps that extend substantially perpendicularly and outwardly from an edge of said mouth such that an outer periphery of each said elongated flap comes in contacting engagement with an interior portion of one of said longitudinal and transverse edges and a first set of tray bend enabling bands substantially disposed along said longitudinal bend axis of said bendable insert tray and a second set of tray bend enabling bands substantially disposed along said longitudinal bend axis of said bendable insert tray; wherein said base is used to hold at least one article affixed to said base and said bendable insert tray is placeable and sealable within said cavity of said bendable envelope to form an assembled mail piece;

said bendable envelope comprises a transverse bend axis centrally disposed and perpendicular to said transverse edges of said bendable envelope and a longitudinal bend axis centrally disposed and perpendicular to said longitudinal edges of said bendable envelope; and when said bendable insert tray is disposed in said bendable envelope to form said assembled mail piece, said bendable insert tray comprises a transverse bend axis substantially co-linear to said bendable envelope's transverse bend axis and a longitudinal bend axis substantially co-linear to said bendable envelope's longitudinal bend axis, and said assembled mail piece bends less than 2 inches in each of the longitudinal and transverse directions when subjected to a transport belt tension of 40 pounds around an 11 inch diameter turn.

2. The automated flat mail piece of claim 1, wherein said at least one article is disposed at a location about said bendable insert tray away from said transverse and longitudinal bend axes of said bendable insert tray.

3. The automated flat mail piece of claim 1, wherein said first set of envelope bend enabling bands of each said panel comprises three equally spaced score lines, spaced at a distance ranging from about 3/16 inch to about 0.5 inch, and two stress relief score lines disposed at each opposing end thereof wherein one of said two stress relief score lines extends from each outermost score line of said three equally spaced score lines to intersect the middle of said three equally spaced score lines in a V-shaped configuration, thereby enabling bending of said panel about an axis substantially coaxial to the middle of said three equally spaced score lines.

4. The automated flat mail piece of claim 1, wherein said second set of envelope bend enabling bands of each said panel comprises three equally spaced score lines, spaced at a distance ranging from about 3/16 inch to about 0.5 inch, and two stress relief score lines disposed at each opposing end thereof wherein one of said two stress relief score lines extends from each outermost score line of said three equally spaced score lines to intersect the middle of said three equally spaced score lines in a V-shaped configuration, thereby enabling bending of said panel about an axis substantially coaxial to the middle of said three equally spaced score lines.

5. The automated flat mail piece of claim 1, wherein said first and second sets of tray bend enabling bands comprise a perforated line.

6. The automated flat mail piece of claim 1, wherein each said flap further comprises two curved exterior corners.

7. The automated flat mail piece of claim 1, further comprising a flap bend enabling band, wherein each said elongated flap comprises two generally parallel opposingly disposed longitudinal edges and two generally parallel opposingly disposed transverse edges, said flap bend enabling band is centrally disposed and perpendicular to said longitudinal edges of said flap and comprises a perforated line having a cutout disposed on each end thereof, thereby enabling both bending of said insert tray about an axis substantially coaxial to said perforated line and limited twisting of said flap about said perforated line.

8. The automated flat mail piece of claim 7, wherein each said cutout is triangularly shaped with its opening disposed along one of said longitudinal edges of said flap and the apex of each said cutout intersecting said perforated line of said flap.

9. The automated flat mail piece of claim 1 comprising a length of from 6 inches to 15 inches and a width of from 5 inches to 12 inches.

10. An automated flat mail piece comprising a bendable envelope and a corresponding bendable insert tray operably placeable in said bendable envelope to form an assembled mail piece, wherein:

said bendable envelope has a cavity defined by two generally rectangular similarly sized overlapped panels that are fixedly sealed on at least two of its four edges and removably sealed on at least one of said four edges, wherein each panel comprises an outer surface and an inner surface, and said outer surface further comprises a substantially rectangular flat portion substantially centrally disposed and delineated by a set of envelope slope transition-enabling bands;

a tapered portion surrounding said flat portion which tapers outwardly and terminates at said four edges;

a first set of envelope bend enabling bands substantially centrally disposed from a first longitudinal edge to a second opposing longitudinal edge; and a second set of envelope bend enabling bands substantially centrally disposed from a third transverse edge to a fourth opposing transverse edge and that are substantially perpendicular to said first and second longitudinal edges;

said bendable insert tray comprises a generally rectangular base having a first set of tray bend enabling bands substantially centrally disposed from a first longitudinal edge to a second opposing longitudinal edge;

a second set of tray bend enabling bands substantially centrally disposed from a third transverse edge to a fourth opposing transverse edge and that are substantially perpendicular to said first and second longitudinal edges, wherein said first and second sets of tray bend enabling bands cooperate to divide said base into four segments, each segment having two outer edges, where each outer edge of each said segment has a thickness-providing wall extending upwardly at substantially right angle therefrom; and each thickness-providing wall has two side edges, wherein one of said two side edges is substantially in contacting engagement with a side edge of an adjacent thickness providing wall;

a generally rectangular mouth defined by four generally elongated flaps, each said elongated flap having an inner longitudinal edge, an outer longitudinal edge and two transverse edges disposed in a plane substantially parallel to a plane of said base and substantially aligned lengthwise to one of said first longitudinal edge, second longitudinal edge, third transverse edge and fourth transverse edge of said base, wherein each said elongated flap is rotatably connected to and supported by two of said thickness providing walls at said inner longitudinal edge and comprises a flap bend enabling band substantially centrally disposed and extending from said inner longitudinal edge to said outer longitudinal edge;

said bendable insert tray is placeable within said cavity such that said outer longitudinal edges of said elongated flaps are positioned in contacting engagement with the interior of said bendable envelope longitudinal and transverse edges such that all said elongated flaps, in combination with all said thickness-providing walls, provide structural integrity to said automated flat mail piece;

said mouth and said base are substantially the size and shape of said flat portion of each said panel; and the periphery of said rectangular mouth and said rectangular base in said assembled mail piece is positioned substantially in contacting engagement with the periphery of said rectangular flat portion of each said panel such that the flatness and thickness of said automated flat mail piece is maintained.

11. The automated flat mail piece of claim 10, wherein said automated flat mail piece satisfies United States Postal Service requirements for an automated flat, the requirements comprising:

said automated flat mail piece must bend easily when subjected to a transport belt tension of 40 pounds;

the amount of bend of said automated flat mail piece must not exceed 2 inches in its lengthwise or widthwise direction;

said automated flat mail piece thickness must be no less than 0.25 inch and no more than 0.75 inch; and said automated flat mail piece must have a certain consistent thickness not varying or deflecting by more than 0.25 inch.

12. The automated flat mail piece of claim 10, wherein said set of envelope slope transition-enabling bands comprise single score lines, and wherein each said score line is substantially parallel to but offset from one of said four edges of each said panel.

13. The automated flat mail piece of claim 10, wherein said first set of envelope bend enabling bands of each said panel comprises three equally spaced score lines, spaced at a distance ranging from about 3/16 inch to about 0.5 inch, and two stress relief score lines disposed at each opposing end thereof wherein one of said two stress relief score lines extends from each outermost score line of said three equally spaced score lines to intersect the middle of said three equally spaced score lines in a V-shaped configuration, thereby enabling bending of said panel about an axis substantially coaxial to the middle of said three equally spaced score lines.

14. The automated flat mail piece of claim 10, wherein said second set of envelope bend enabling bands of each said panel comprises three equally spaced score lines, spaced at a distance ranging from about 3/16 inch to about 0.5 inch, and two stress relief score lines disposed at each opposing end thereof wherein one of said two stress relief score lines extends from each outermost score line of said three equally spaced score lines to intersect the middle of said three equally spaced score lines in a V-shaped configuration, thereby enabling bending of said panel about an axis substantially coaxial to the middle of said three equally spaced score lines.

15. The automated flat mail piece of claim 10, wherein each said elongated flap further comprises two curved exterior corners defined by the intersection of each said transverse edge and each said outer longitudinal edge of each said elongated flap.

16. The automated flat mail piece of claim 10, wherein each said flap bend enabling band comprises a perforated line having a cutout disposed on each end thereof, thereby enabling both bending of said bendable insert tray about an axis substantially coaxial to said perforated line and limited twisting of said elongated flap about said perforated line.

17. The automated flat mail piece of claim 16, wherein each said cutout is triangularly shaped with an opening of said cutout disposed along a longitudinal edge of said elongated flap and the apex of said cutout intersecting said perforated line of said elongated flap.

18. The automated flat mail piece of claim 10, wherein each of said first and second sets of tray bend enabling bands comprises a perforated line.

19. The automated flat mail piece of claim 10, wherein said bendable envelope and said bendable insert tray are each constructed of a single sheet of card stock having a thickness ranging from 8 points to 30 points using a die-cut process.

20. The automated flat mail piece of claim 10, wherein at least one cut is made in said base such that a portion of an article to be delivered in said automated flat mail piece may be secured to an attachment point created with said at least one cut.

21. The automated flat mail piece of claim 10, wherein said bendable envelope further comprises an envelope flap that extends from a first panel of said two panels at said at least one removably sealed edge and is wrapped over and removably attached to a second panel of said two panels at said at least one removably sealed edge such that said bendable envelope is sealed.

22. The automated flat mail piece of claim 21, wherein said envelope flap further comprises two flex enabling cuts, each cut disposed substantially along an edge adjacent said at least one removably sealed edge.

23. The automated flat mail piece of claim 10, wherein said bendable envelope and bendable insert tray are constructed from reusable or recyclable materials.

* * * * *